US007929878B1

(12) United States Patent
Thayer et al.

(10) Patent No.: US 7,929,878 B1
(45) Date of Patent: Apr. 19, 2011

(54) PHOTORECEPTOR FILMING REDUCTION AND LONG PHOTORECEPTOR LIFE THROUGH ADJUSTMENT OF CLEANING BLADE WORKING ANGLE

(75) Inventors: Bruce E Thayer, Spencerport, NY (US); Aaron M Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/621,207

(22) Filed: Nov. 18, 2009

(51) Int. Cl.
*G03G 15/00* (2006.01)

(52) U.S. Cl. ..... 399/71

(58) Field of Classification Search ..... 399/71, 399/99, 123, 126, 149, 326, 367, 350, 351
See application file for complete search history.

(56) References Cited

U.S. PATENT DOCUMENTS

| | | | | |
|---|---|---|---|---|
| 6,282,401 | B1 * | 8/2001 | Proulx et al. | 399/350 |
| 2001/0026705 | A1 * | 10/2001 | Sato et al. | 399/98 |
| 2004/0105710 | A1 * | 6/2004 | Shakuto et al. | 399/350 |
| 2007/0019989 | A1 * | 1/2007 | Nakamori | 399/159 |
| 2008/0008489 | A1 * | 1/2008 | Watanabe et al. | 399/71 |

* cited by examiner

*Primary Examiner* — David P Porta
*Assistant Examiner* — Marcus H Taningco
(74) *Attorney, Agent, or Firm* — Ronald E. Prass, Jr.; Prass LLP

(57) ABSTRACT

An electrostatic marking system has a cleaning station and a cleaning blade wherein the cleaning blade is adjustable depending upon data of cleaning station temperature, humidity, and a contaminant film on a photoreceptor P/R surface. A sensor or sensors measures this data including the thickness of the film together with temperature and humidity in the cleaning station. This data is conveyed by the sensors to a controller which has software equating this data with an angle at which the cleaning blade contacts the P/R surface. This angle is calculated to give maximum cleaning of the P/R surface with minimum abrading of this P/R surface.

20 Claims, 6 Drawing Sheets

PHOTORECEPTOR FILMING REDUCTION AND LONG PHOTORECEPTOR LIFE THROUGH ADJUSTMENT OF CLEANING BLADE WORKING ANGLE

The present invention relates to an electrophotographic marking system and, more specifically, relates to a cleaning blade and cleaning station useful in said system.

BACKGROUND

In marking systems such as xerography or other electrostatographic processes, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The toner may be in dry powder form or suspended in a liquid carrier. The charged toner being electrostatically attached to the latent electrostatic image areas creates a visible replica of the original. The developed image is then usually transferred from the photoreceptor surface to a final support material such as paper and the toner image is fixed thereto to form a permanent record corresponding to the original.

In these electrostatic marking systems, a photoreceptor surface is generally arranged to move in an endless path through the various processing stations of the xerographic process. Sometimes the photoreceptor is in the form of an endless belt and in other systems in the form of a drum. Since the photoreceptor surface is reusable when the toner image is transferred to a final support material such as paper, the surface of the photoreceptor is cleaned and prepared to be used once again in the copying process. In this endless path, several xerographic-related stations are traversed by the photoconductive belt or drum.

In these type of systems, after the transfer station, a photoconductor cleaning station is next. This cleaning station may comprise a cleaning brush and subsequent to the brush is positioned a spots cleaning blade or doctor blade which is used to remove residual debris from the belt. Toner particles, toner additives, machine wear debris, paper fillers or coatings and other contaminants can create film on the photoconductor surface. Also, a film or debris can be generally caused by the toner or toner additives being impacted onto the belt by the cleaning brushes.

"Blade cleaning" is a technique for removing toner and debris from a photoreceptor. In a typical application, a relatively thin metal or elastomeric blade member is supported adjacent to and transversely across the photoreceptor surface with a blade edge that chisels or wipes toner from the surface. Toner accumulating adjacent to the blade is transported away from the blade area by a toner transport arrangement or by gravity. Blade cleaning, generally, is advantageous over other cleaning systems due to its low cost, small cleaner unit size, low power requirements and simplicity. However, conventional blade-cleaning systems suffer from short blade life due to early, random failures in addition to short photoreceptor life due to excess abrading by the blade.

Photoreceptor surfaces can accumulate films that cause print quality degradation and limit the useful life of the photoreceptor. The films may be composed of particulate material that is ground into or smeared on the surface of the photoreceptor. Toner particles, toner additives, machine wear debris, paper fillers or coatings and other contaminant particles can create films. Other films may be due to interactions between the photoreceptor surface and chemicals in the machine environment. Effluents generated by the photoreceptor charge devices are a common source of chemical interactions as well as environmental contaminants that can cause lateral charge migration (LCM) defects. Standard countermeasures to films are to reduce or eliminate the source of the film or to remove the film by increasing abrasion of the photoreceptor surface. In many cases, it is difficult or impossible to reduce the filming source to the point where no print defects are ever generated. Photoreceptor surface abrasion for film removal is difficult to perform in a controlled manner and in all cases reduces the useable life of the photoreceptor.

In many xerographic print systems, the useable life of the photoreceptor (P/R) is a critical factor in determining the overall running cost of the printer. There are at least two primary failure modes for most photoreceptors. The first is the degradation in function due to electrical and mechanical wear of the photoreceptor surface. A second failure mode is the accumulation of contaminants or films on the surface of the photoreceptor. Depending on the operating conditions of the xerographic engine, either of these two failures modes can be more or less dominant. These operating conditions would include, but are not limited to, document area coverage, media type, ambient temperature and relative humidity. Thus, balancing the two P/R failure modes is typically key to managing the run cost for the xerographic engine.

In printing architectures that utilize blade cleaners, the working angle of the cleaning blade typically impacts the rate of photoreceptor wear. Because of this, the blade working angle can be used as a means for actively adjusting the rate of surface wear on the photoreceptor. The blade angle provides a means for balancing the amount of photoreceptor wear and the buildup of films. At higher working angles, usually there is faster photoreceptor P/R wear but also less filming. At lower working angles, usually there is a higher degree of filming but substantially less wear of the photoreceptor surface.

By actively adjusting the blade working angle, it is possible to trade off the rate of P/R wear with the degree of filming. With a known latitude boundary for the acceptable level of filming, the goal would be to steer the working angle as low as possible thereby minimizing the photoreceptor wear rate while maintaining acceptable levels of film accumulation.

Film generation rates will vary based on xerographic system parameters and uncontrolled environmental and usage parameters. Because of these variations, it is very difficult to predict the resulting accumulated film thickness. When the accumulated film thickness is below the threshold acceptable film limit, the blade can be operated at low working angles. Low working angles maximize photoreceptor life by minimizing photoreceptor wear. As the film thickness approaches or reaches the acceptable limit, the blade working angle is increased to thereby increase photoreceptor wear. The additional wear reduces the film thickness to maintain acceptable film thickness and acceptable images.

To optimize photoreceptor life, the film thickness as indicated by a sensor or sensors is held at the maximum acceptable limit. In this condition there would be no print defects due to filming and photoreceptor life would be maximized by operating the blade at high working angles only as often as necessary to prevent film thickness rising to unacceptable levels. The blade working angle would be adjusted to match the film removal rate to variations in the film generation rate so that the film thickness is maintained at the acceptable limit.

SUMMARY

Testing has shown cleaning blade working angle to be one of the most significant factors in photoreceptor wear rate. This invention provides operating the cleaning blade and the spots blade at a low working angle to minimize wear and substantially increase photoreceptor life. As required, the cleaning blade or spots blade working angle will be increased to more aggressively wear the photoreceptor surface for removal of films. In its simplest form, the blade working angle will be increased periodically based on print count or photoreceptor cycles. Spots blades are blades that follow electrostatic brush cleaners to remove spots and films that are not removed well by the soft contact cleaning brushes. Spots blades, since they follow a very effective cleaner, get very little toner lubrication. These blades can be operated at very low working angles—all the way approaching 0° at the lower end of the tolerance range. At such low working angles they do not clean toner well but they do avoid blade chatter and flipping. The blades are also usually harder and operate at lower blade loads than cleaning blades. Spots blades have been used to control spots and films with a number of electrostatic brush cleaners. The spots blades have been either interference or force (weight) loaded. In either loading case, the working angle is not adjusted. This invention could also be applied to spots blades used with electrostatic brush cleaners or other soft contact cleaners (magnetic brush, mechanical brush, foam roll). Since spots blades already function to remove spots and films, the working angle adjustment of the spots blade would be to control the aggressiveness of photoreceptor wear. The spots blades can have their own sensors and controller apart from the conventional cleaner blade sensors and controllers or they can use the same sensors and controllers as the conventional cleaner blades. Throughout this disclosure, the term "cleaning blade" will be used. This term includes both spots blades and conventional cleaning blades. More advanced control schemes will use knowledge of the printing conditions and machine environment or filming sensors to determine when to initiate the enhanced wear rate mode. Control of photoreceptor wear rate through adjustment of the cleaning blade working angle will optimize photoreceptor life by operating in the high wear rate mode only when conditions to generate filming print defects are present. The strength of cleaning blade working angle in contributing to photoreceptor wear rate can be used to both minimize photoreceptor wear rate and to increase photoreceptor wear rate to remove photoreceptor films. Photoreceptor film growth can be controlled by varying the amount of time that the cleaning blade is operated in a high working angle position. High film growth rates require that the cleaning blade be operated at a high working angle position for as long as the high filming growth rate conditions persist. For intermediate film growth rate conditions, the cleaning blade could alternate between high and low working angles to reduce the film thickness without excessively wearing the photoreceptor. When a blade cleaner is always in the high working angle it may excessively erode and abrade the photoreceptor surface even though the extreme high working angle is not warranted. The present invention only uses the blade working angle that is specifically needed for properly and efficiently cleaning the photoreceptor without excessive and unneeded abrading of the photoreceptor.

A wide useable range of working angle adjustments is 2° to 20°. At the high end of working angle range, 20° is very high. At some point, the blade will chatter or flip at high working angles but under the right lubrication conditions 20° should work. A more typical preferred angle range is from about 4° to about 16°. Nominal working angles of 8° to 12° are common. The working angles chosen for a specific application will depend on the film thickness, the friction of the contacting toner, photoreceptor and blade. Also, the level of adhesion of the toner to the photoreceptor will determine the blade loads and working angles needed to clean toner with a particular blade material.

A sensor or sensors placed in relationship to the photoreceptor surface will indicate the film thickness and other factors such as the temperature and humidity in the cleaning station. A controller and/or stepper motor is in communication with the sensor(s) and will automatically adjust the angle of the blade so that sufficient cleaning performance will be effected with minimum photoreceptor abrasion.

The printer is operated in normal mode until a predetermined cycle count threshold has been reached. At this point, an update cycle is instituted in which the degree of photoreceptor filming is measured using the sensor. Such a measurement could be scheduled to occur within the normal process control cycle or during a separate cycle. The photoreceptor filming measurement is then used by the controller to calculate a new blade working angle setting. This setting can be any angle within a continuous range between a defined minimum and maximum value such as from 2° to 20°. As earlier noted, the preferred working angle is from about 4° to about 16°. In an alternate embodiment, said angle could take discrete values within predefined limits. Once calculated, the new blade working angle is applied using a blade setup means.

During normal operation of the printer or marking system, the temperature and humidity sensors are monitored. If a significant change in these sensors is detected beyond a predetermined threshold, then an update to the blade working angle is instituted. The photoreceptor sensitivity to filming is calculated based on a number of factors including, but not limited to, the temperature and humidity sensor readings. Next, the required blade working angle is determined using the calculated filming sensitivity. Finally, the new blade working angle is applied using a blade setup means.

The controller is configured to maintain the blade setting at an effective cleaning angle until the P/R film is substantially removed or reduced, then configured to reset blade angle to a lower wear position until film re-growth requires controller setting the angle again to a more aggressive cleaning position.

DETAILED DISCUSSION OF DRAWINGS AND PREFERRED EMBODIMENTS

Figure 1:
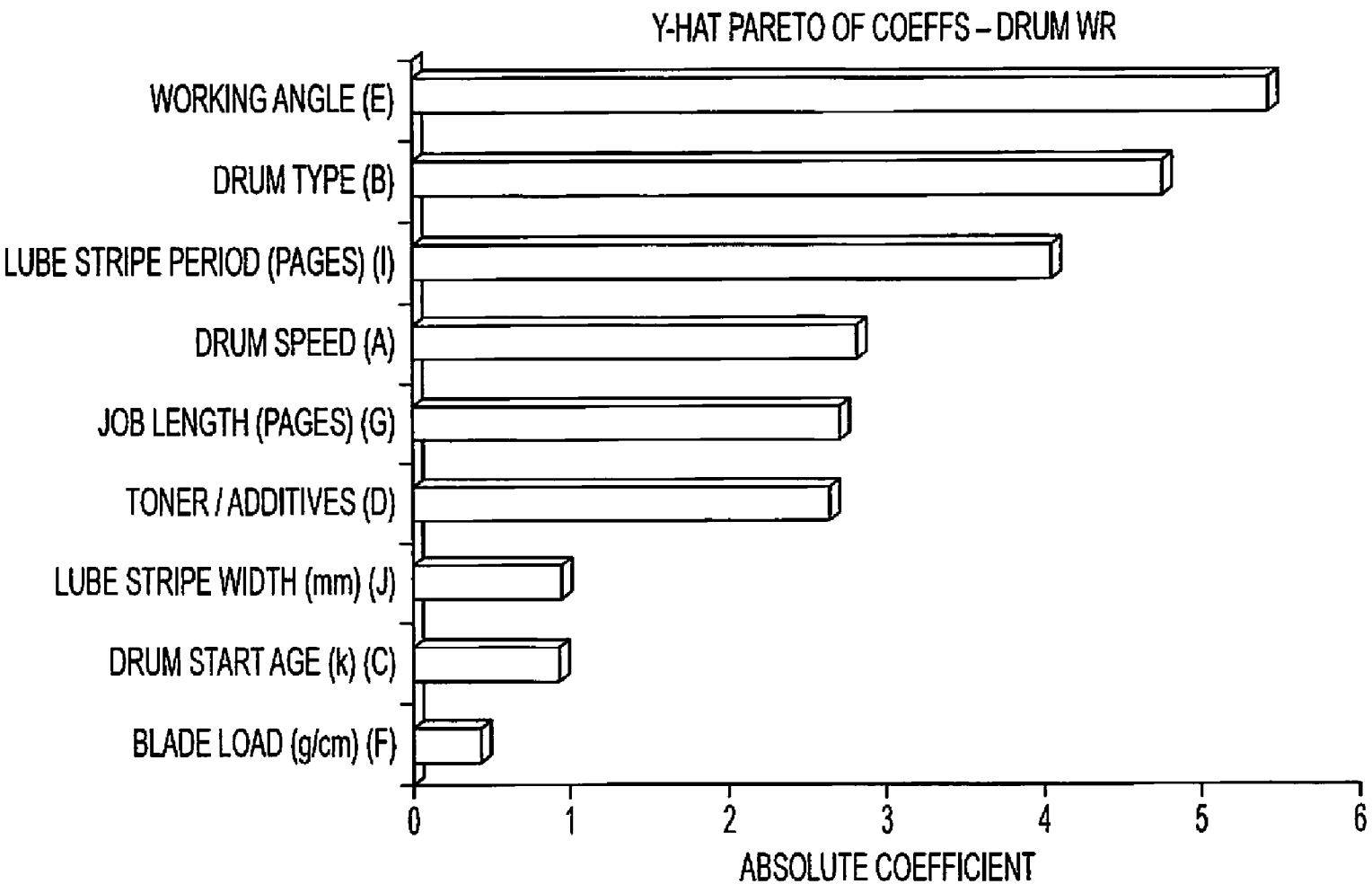
FIG. 1 illustrates a bar diagram illustrating factors influencing photoreceptor wear in a xerographic system.
Figure 3A:
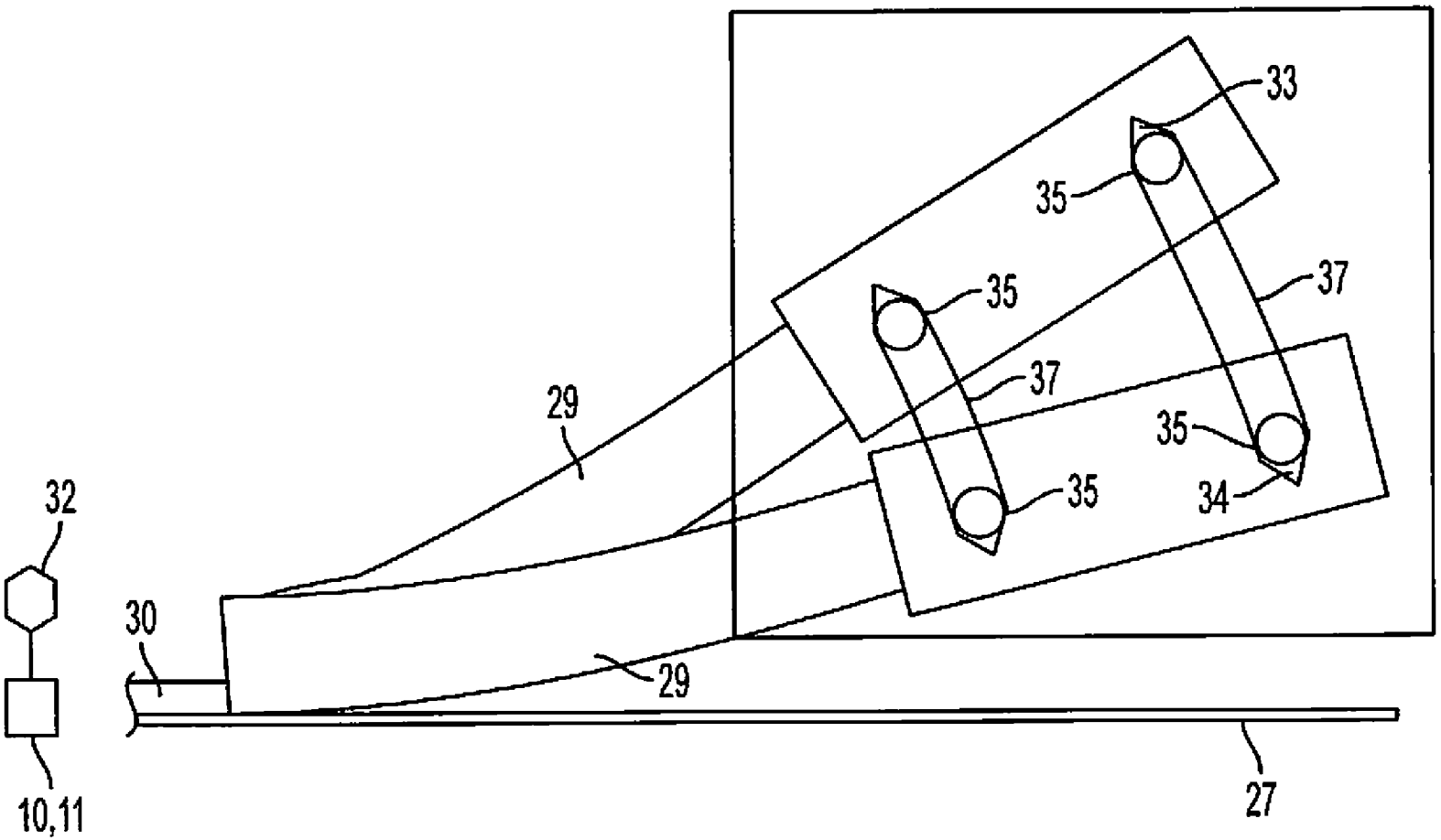
FIG. 3A illustrates an embodiment of an adjustable cleaning blade of this invention with high and low working angle positions.
Figure 3B:
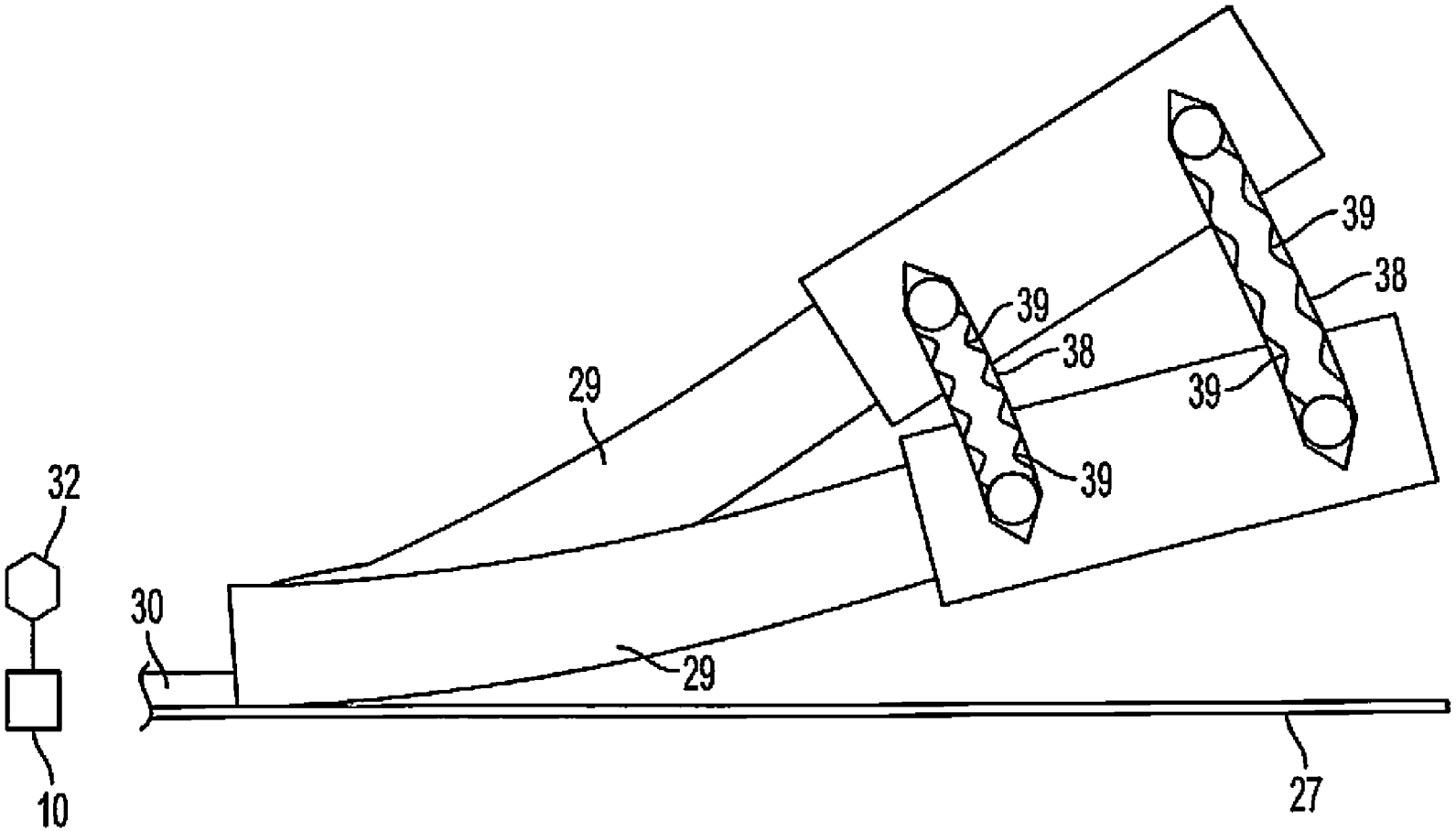
FIG. 3B illustrates an embodiment of an adjustable cleaning blade with a plurality of working angle adjustment positions.
Figure 4:
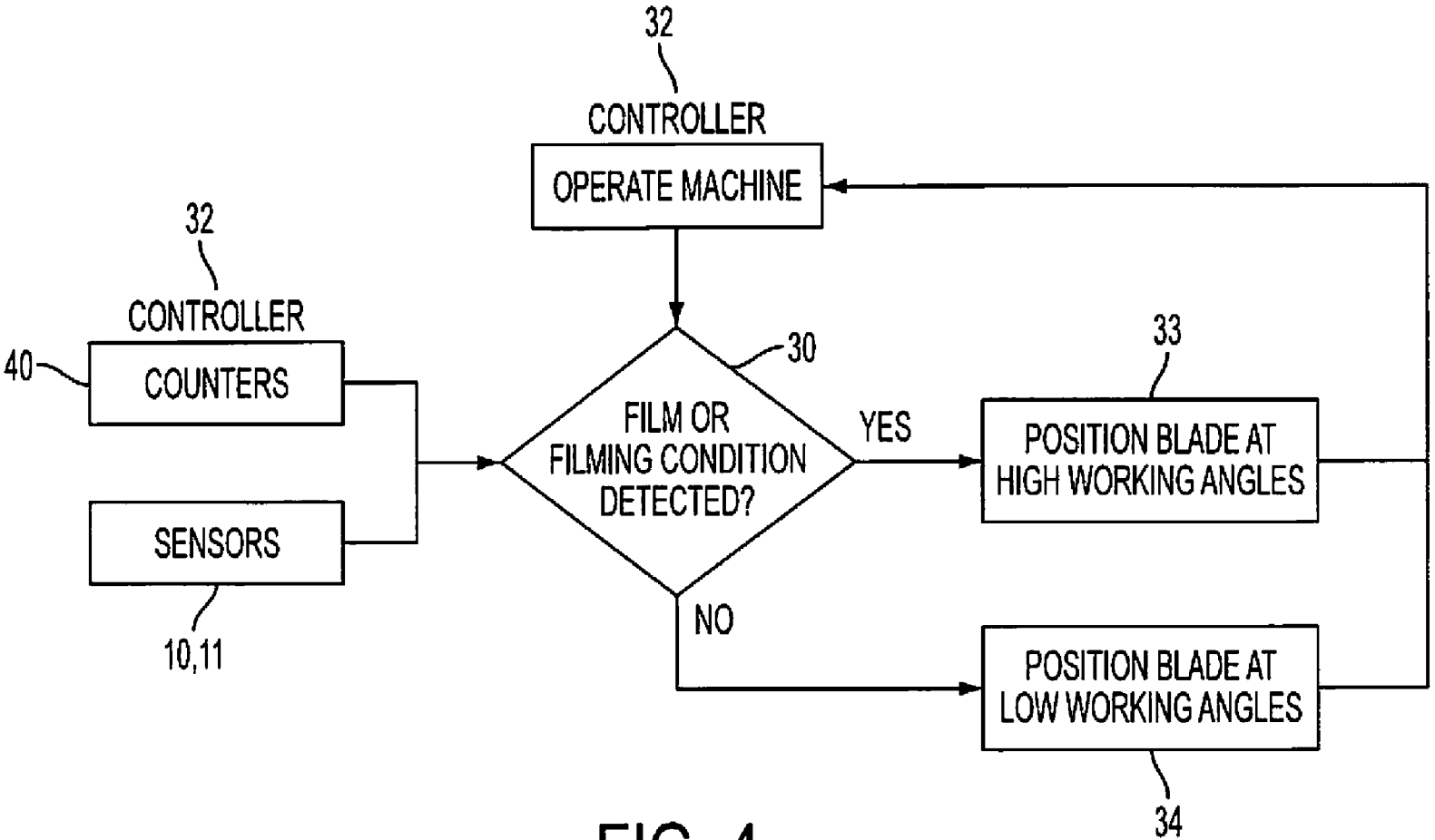
FIG. 4 illustrates a simple flow diagram for determining what blade working angle to use in the cleaning step.
Figure 5:
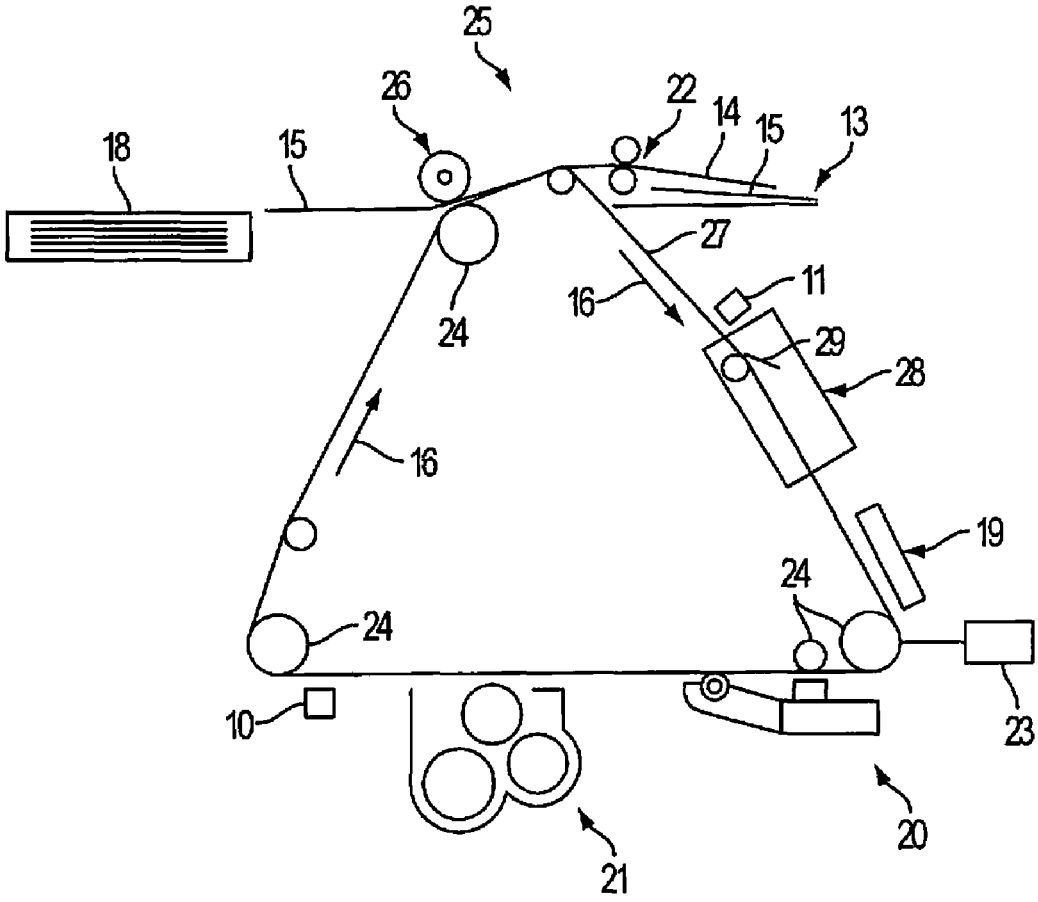
FIG. 5 is an illustration of an electrophotographic marking system using the adjustable cleaning blade of this invention.

For drawing number references to system components used in reference to FIGS. 1-4, see FIG. 5. In FIG. 1, the strength of cleaning blade 29 working angle in contributing to photoreceptor 27 wear rate can be used to both minimize photoreceptor wear rate under normal running conditions and to increase photoreceptor wear rate to remove photoreceptor films 30. Photoreceptor films 30 can consist of adhered hard particulates, smeared soft material or chemical modifications to the photoreceptor surface. The hard particulates and soft material typically come from toner additives, photoreceptor and machine wear debris, paper fillers and coatings, and contaminants brought into the machine by cooling air flow. The chemical modifications are typically due to corona effluents from charge devices, out gassing from plastic components and environmental contaminants brought into the machine by cooling air flow. Normal, low level photoreceptor wear rates are often enough to prevent photoreceptor films from building up to the point where print defects occur. The growth of photoreceptor films is, however, a function of the available quantity of filming materials and machine internal environmental conditions, e.g., temperature and relative humidity. The availability of filming materials can be influenced by machine running conditions, e.g., job lengths and print area coverage, as well as the type of charge devices used, machine air flow, paper feeder type, single or multiple transfer, development housing type and toner additive types, quantities and adhesion to the toner. A designed experiment was performed to identify the cleaning blade related factors influencing photoreceptor wear. FIG. 1 shows a Pareto of the relative importance of each factor to photoreceptor wear rate. Blade working angle is the most significant among the factors tested. Low cleaning blade working angles minimize photoreceptor wear rate.

Figure 2:
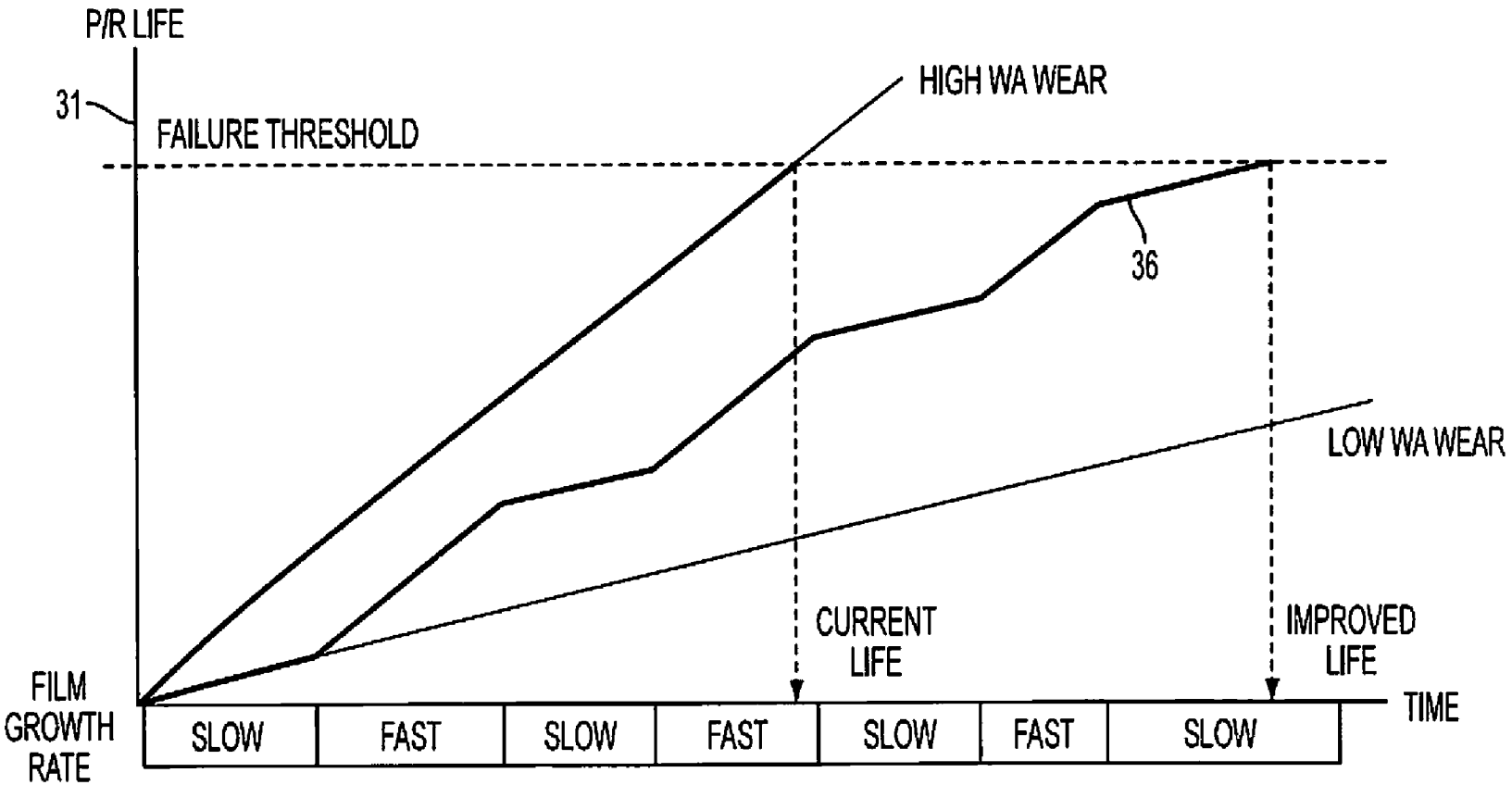
FIG. 2 is a graph showing photoreceptor (PR) life improvement through adjustment of cleaning blade working angle.

In FIG. 2, due to variations in the factors influencing the creation of photoreceptor surface films 30, some operating conditions will result in a slow film growth rate and other operating conditions will result in a fast film 30 growth rate. This invention proposes to operate the cleaning blade 29 at a low working angle when the film 30 growth rate is slow so that the photoreceptor 27 wear rate is low. A low photoreceptor 27 wear rate will provide adequate removal of photoreceptor films 30 with a slow growth rate and maximize the life of the photoreceptor 27. When conditions exist for a fast film growth rate, the cleaning blade working angle will be increased to increase the photoreceptor 27 wear rate. The higher photoreceptor wear rate will decrease the life of the photoreceptor 27 but will prevent the occurrence of print defects due to films 30. By adjusting the cleaning blade working angle to wear the photoreceptor surface at a rate appropriate to the growth rate of photoreceptor films 30, the defect-free life of the photoreceptor will be maximized. Current practice is to use a fixed photoreceptor wear rate that attempts to minimize the costs of photoreceptor failures due to both filming defects and surface wear defects. A fixed photoreceptor wear rate must accommodate fast filming growth rates so photoreceptor wear is typically greater than necessary with slower filming growth rates.

As an illustration of how changing cleaning blade working angle could improve photoreceptor life, a simple example will be given. FIG. 2 shows photoreceptor wear over time. Wear rates are shown for high and low cleaning blade working angles. A failure threshold is shown for defects due to excessive photoreceptor wear. The line 31 shows the expected photoreceptor life under the current fixed, high working angle machine operation. The high working angle is chosen to provide an adequate photoreceptor wear rate to remove films growing at a fast rate. In order to illustrate the impact on photoreceptor life of changing cleaning blade 29 working angle based on the actual film growth rate, the time axis is broken into regions of fast and slow film growth rates. During the slow film growth rate, the cleaning blade is operated at a low working angle. During the fast film growth rate, the cleaning blade is operated at a high working angle. The line 36 shows the expected photoreceptor life using adjustment of the cleaning blade 29 working angle based on filming growth rates.

As illustrated in FIG. 2, the cleaning blade 29 working angle is adjusted between only a high working angle for fast film growth and a low working angle for slow film growth. It is, of course, obvious that the cleaning blade working angle could be adjusted to a plurality of intermediate values as shown in FIG. 3B to correspond to intermediate film growth rates. As a practical matter, in some instances it may be more convenient to have only two working angle positions as shown in FIG. 3A for the cleaning blade. Photoreceptor film growth could then be controlled by varying the amount of time that the cleaning blade was operated in the high working angle position. Very high film growth rates would require that the cleaning blade 29 be operated at the high working angle position for as long as the high filming growth rate conditions persisted. For intermediate film growth rate conditions, the cleaning blade could alternate between high and low working angles to reduce the film thickness without excessively wearing the photoreceptor.

As illustrated in FIG. 4, the printing machine controller 32 would supply control signals to initiate changes in the cleaning blade 29 working angle. The controller 32 would initiate working angle changes based on decision logic and machine operational information. The machine operation information could be very basic, e.g., print count, photoreceptor cycle count, temperature and relative humidity. More advanced information could include development toner concentration, toner dispense history, toner residence time in the developer, development and background biases, print area coverage history, job length, lubrication stripe development history and paper type. Even more advanced information could include direct or indirect sensor measurement of the film state of the photoreceptor surface. Indirect measurement of photoreceptor films could be obtained from sensors detecting filming defects on the output prints or on intermediate substrates (e.g. a full-width array image sensor measuring LCM artifacts on the intermediate belt during diagnostic cycles). Direct measurement of photoreceptor films 30 could be obtained by optical sensors 10 and 11 detecting reflectance changes with film build-up, capacitive or resistance sensors detecting changes in the electrical properties of the photoreceptor surface or mechanical sensors measuring changes in drag due to frictional changes on the photoreceptor surface.

Movement of the cleaning blade 29 from one working angle to another can be accomplished through a number of methods. An important consideration is that working angle and blade load are both changed when blade to photoreceptor interference or blade holder angle are changed alone. If the working angle is to be changed with little or no change in the blade load, then both the blade holder angle and the blade to photoreceptor interference must be changed simultaneously. Fortunately, as shown in FIG. 1, blade load is not a large contributor to photoreceptor wear rate and reasonable changes in blade load could be made with small changes in photoreceptor wear rate. The mechanism that moves the blade into contact with the photoreceptor could be controlled by controller 32 to hold the blade at two or more working angle positions. An illustration of another example mechanism is shown in FIGS. 3A and 3B.

In FIG. 3A, the blade 29 of this invention is moved from high 33 to low 34 working angle positions by sliding locator pins 35 in guide slots 37. The actuator could be a controller 32 with a motor or solenoid and/or appropriate software (not shown). The blade 29 may be made from an elastomer or metal or any other suitable material. The photoreceptor 27 may be any suitable photoreceptor that may contain contaminated film in use. The thickness and other aspects of the film 30 are sensed by sensors 10 and 11 in communication with controller 32. While, for illustration and clarity only, two blade positions 33 and 34 are shown. Any suitable number of adjusting positions may be used as shown in FIG. 3B. FIG. 3A may also represent a large number of adjusting positions if a suitable means, e.g., a stepper motor, is used to move and stop the blade anywhere between positions 33 and 34.

In FIG. 3B, blade 29 is shown using sliding locator pins 35 and calibrated, multiple guide slots 38 where the blade angle can be adjusted in a plurality of angle positions of from about 2° to about 20° by use of several notches 39. The sensors 10 and 11 will sense the thickness and condition of film 30 and temperature and humidity in the cleaning station and convey this information to controller 32. The controller 32 will then adjust the blade 29 to any of the plurality of positions of from about 2° to about 20° by use of notches 39 in calibrated guide slots 38.

In FIG. 4, a simple flow diagram for determining which blade 29 working angle to use is illustrated. The inputs to the decision can be from sensors 10 and 11 mounted in the machine and/or from counters 40 recording relevant machine use history. The cleaning blade continues to operate in the high working angle position until the film or filming conditions are no longer detected. Cleaning blade 29 operation is then returned to the low working angle position 34.

In FIG. 5, an electrophotographic marking system using the adjustable cleaning blade 29 in its cleaning station 28 is shown. While the marking system 25 is shown as a monochromatic one unit system, it is obvious several units 25 may be used in color systems having more than one xerographic unit 25.

In FIG. 5, a schematic of a xerographic marking system 25 where a photosensitive belt 27 is used is shown. However, a photosensitive drum with the same xerographic stations can be equally used. The adjustable cleaning blade 29 of the invention is used in cleaning station 28 as shown in drum cleaning of FIGS. 3A and 3B. The components of xerographic marking system of this invention, as shown in FIG. 5, include a sensor or sensors 10 and 11 to determine film thickness 30 and temperature and humidity in the cleaning station 28 on P/R surface 27. Shown in FIG. 5 are a Xerographic system 25, a stacking assembly 13, a collection station 14, paper 15, paper feed 18, a charging station 19, an exposure station 20, a developer station 21, a fusing station 22, a motor 23, rollers 24, a transfer station 26, a photoconductor belt 27 (or drum with same stations), and a cleaning station 28.

In summary, this invention provides a novel electrostatic marking system, a novel cleaning station and a novel method of abrading a P/R surface. The electrostatic marking system comprises a cleaning station. This cleaning station comprises a photoreceptor (P/R) surface, at least one sensor and at least one controller, and at least one cleaning blade in a blade cleaning angle contact with the photoreceptor surface. The photoreceptor surface has a contaminant film thereon. The sensor is configured to measure data from the cleaning station, including a thickness of the contaminant film. The sensor is in communication with the controller and is configured to send the data to the controller. The controller comprises predetermined algorithms equating contact angle of the cleaning blade against the measured data. The controller is configured to adjust and set the blade cleaning angle and a cleaning blade adjuster in accordance with the data to provide substantially maximum P/R film cleaning together with minimum abrading of the P/R.

The controller is in communication with a blade setup means. In a preferred embodiment, this blade setup means is a stepper motor, where the stepper motor is configured to move the cleaning blade to various P/R contact angles of from about 2° to 20. The blade cleaning angle with the P/R is preferably from about 4° to about 16°. The cleaning blade comprises a plurality of P/R angle settings ranging from about 2° to about 20°. The controller during functioning of the marking system is configured to regularly receive the data from the sensors and configured to adjust the blade cleaning angle accordingly. The controller is configured to maintain the cleaning blade at an effective cleaning angle until the film is substantially reduced or removed, and the controller configured after the film is reduced or removed to reset the blade cleaning angle to a home position. The cleaning blade has an adjuster. In a preferred embodiment this adjuster comprises guide slots with locater pins on each end of the guide slots. The guide slots have a plurality of notches or angle settings configured to set the blade cleaning angles to from about 2° to about 20° as instructed by said controller after receiving data from the sensors.

Also included in this invention is a cleaning station of an electrostatic marking system, this cleaning station comprises a photoreceptor P/R surface, at least one sensor, at least one controller, and at least one cleaning blade in a blade cleaning angle contact with the photoreceptor surface. The photoreceptor surface has a contaminant film thereon, the sensor is configured to measure data of said cleaning station including cleaning station conditions, a thickness of the contaminant film, the sensor is in communication with the controller and is configured to send this data to said controller. The controller is configured to adjust and set the blade cleaning angle and cleaning blade adjuster in accordance with the data to provide substantially maximum P/R film cleaning together with minimum abrading of said P/R.

The method of this invention is useful in a cleaning station of an electrostatic marking system, this method comprising providing in the cleaning station a photoreceptor (P/R) surface, at least one sensor and at least one controller, and at least one cleaning blade. The cleaning blade is positioned in a blade cleaning angle contact with the photoreceptor surface. A photoreceptor surface is provided containing a contaminant film comprising toner, toner additives and other impurities. The sensors are arranged in the system to measure data, including cleaning station temperature, humidity and thickness of the film, the sensors are positioned in communication with the controller, these sensors will communicate the data to the controller. The controller is provided with predetermined algorithms equating an angle of the contact measured against the data, the controller is provided to adjust and set the blade cleaning angle and cleaning blade adjuster in accordance with the data to provide thereby substantially maximum P/R film cleaning together with minimum abrading of the P/R. The controller is in communication with a stepper motor, providing the stepper motor to move the cleaning blade to various P/R contact angles of from about 2° to 20°.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrostatic marking system comprising a cleaning station, said cleaning station comprising:

a photoreceptor P/R surface, at least one sensor and at least one controller, at least one cleaning blade in a blade cleaning angle contact with said photoreceptor surface, said photoreceptor surface having a contaminant film thereon, said sensor configured to measure data (measured data) of said cleaning station including a thickness of said contaminant film or data that can be used to determine contaminant film thickness or the rate of contaminant film growth, said sensor in communication with said controller and configured to send said data to said controller, said controller comprising predetermined algorithms equating contact angle of said cleaning blade against said measured data, said controller configured to adjust and set said blade cleaning angle and a cleaning blade adjuster in accordance with said data to provide substantially maximum P/R film cleaning together with minimum abrading of said P/R.

2. The marking system of claim 1 wherein said controller is in communication with a stepper motor, said stepper motor is configured to move said cleaning blade to various P/R contact angles of from about 2° to 20°.

3. The marking system of claim 1 wherein said blade cleaning angle with said P/R is from about 4° to about 16°.

4. The marking system of claim 1 wherein said cleaning blade comprises a plurality of P/R contact angle settings ranging from about 8° to about 12°.

5. The marking systems of claim 1 wherein said controller during functioning of said system is configured to periodically receive said data from said sensors and configured to adjust said blade cleaning angle accordingly.

6. The marking system of claim 1 wherein said controller is configured to set said cleaning blade to an effective cleaning angle until said film is substantially reduced or removed, and said controller configured after said film is reduced or removed to reset said blade cleaning angle to a reduced abrasion position.

7. The marking system of claim 1 wherein said cleaning blade adjuster comprises guide slots with locater pins on each end of said guide slots, said guide slots having a plurality of notches or angle settings configured to set said blade cleaning angles to from about 2° to about 20° as instructed by said controller.

8. A cleaning station of an electrostatic marking system, said cleaning station comprising:

a photoreceptor P/R surface, at least one sensor and at least one controller, at least one cleaning blade in a blade cleaning angle contact with said photoreceptor surface, said photoreceptor surface having a contaminant film thereon, said sensor configured to measure data (measured data) of said cleaning station including a thickness of said contaminant film or data that can be used to determine contaminant film thickness or the rate of contaminant film growth, said sensor in communication with said controller and configured to send said data to said controller, said controller comprising predetermined algorithms equating contact angle of said cleaning blade against said measured data, said controller configured to adjust and set said blade cleaning angle and cleaning blade adjuster in accordance with said data to provide substantially maximum P/R film cleaning together with minimum abrading of said P/R.

9. The cleaning station of claim 8 wherein said controller is in communication with a stepper motor, said stepper motor is configured to move said cleaning blade to various P/R contact angles of from about 2° to 20°.

10. The cleaning station of claim 8 wherein said blade cleaning angle with said P/R is from about 4° to about 16°.

11. The cleaning station of claim 8 wherein said cleaning blade comprises a plurality of P/R contact angle settings ranging from about 8° to about 12°.

12. The cleaning station of claim 8 wherein said controller during running of said electrostatic system is configured to periodically receive said data from said sensors and configured to adjust said blade cleaning angle.

13. The cleaning station of claim 8 wherein said controller is configured to set said cleaning blade to an effective cleaning angle until said film is substantially reduced or removed, and said controller configured after said film is reduced or removed to reset said blade cleaning angle to a reduced abrasion position.

14. The cleaning station of claim 8 wherein said cleaning blade adjuster comprises guide slots with locator pins on each end of said guide slots, said guide slots having a plurality of notches or angle settings configured to set said blade cleaning angles to from about 2° to about 20° as instructed by said controller.

15. A method useful in a cleaning station of an electrostatic marking system, said method comprising providing in said cleaning station:

a photoreceptor P/R surface, at least one sensor, at least one controller, and at least one cleaning blade, positioning said cleaning blade in a blade cleaning angle contact with said photoreceptor surface, providing a photoreceptor surface containing a contaminant film comprising toner and toner additives, arranging said sensor in said system to measure data (measured data) useful for determining film thickness or film thickness growth rate, including cleaning station temperature and humidity, or direct measurement of said film thickness, providing said sensor in communication with said controller, said sensor communicating said data to said controller, providing said controller with predetermined algorithms equating an angle of said contact measured against said data, providing said controller to adjust and set said blade cleaning angle and cleaning blade adjuster in accordance with said data to provide thereby substantially maximum P/R film cleaning together with minimum abrading of said P/R.

16. The method of claim 15 wherein said controller is in communication with a stepper motor, providing said stepper motor to move said cleaning blade to various P/R contact angles of from about 2° to 20°.

17. The method of claim 15 wherein said blade cleaning angle with said P/R is provided from about 4° to about 16°.

18. The method of claim 15 wherein said cleaning blade is provided a plurality of settings of P/R contact angle ranging from about 8° to about 12°.

19. The method of claim 15 wherein said controller is provided to periodically set said cleaning blade to an effective cleaning angle until said film is substantially reduced or removed, and said controller is provided to reset said blade cleaning angle to a home position.

20. The method of claim 15 wherein said cleaning blade adjuster is provided with guide slots with locater pins on each end of said guide slots, said guide slots having a plurality of notches or angle settings provided to set said blade cleaning angles to from about 2° to about 20° as instructed by said controller.

* * * * *